US011320132B2

(12) United States Patent
Girolami

(10) Patent No.: US 11,320,132 B2
(45) Date of Patent: May 3, 2022

(54) JUNCTION UNIT FOR USE IN A LIGHTING BALLOON APPARATUS

(71) Applicant: Sourcemaker, Inc., Valley Cottage, NY (US)

(72) Inventor: Peter R. Girolami, Wilmington, NC (US)

(73) Assignee: Sourcemaker, Inc., Valley Cottage, NY (US)

( * ) Notice: Subject to any disclaimer, the term of this patent is extended or adjusted under 35 U.S.C. 154(b) by 0 days.

(21) Appl. No.: 16/844,366

(22) Filed: Apr. 9, 2020

(65) Prior Publication Data

US 2021/0317978 A1 Oct. 14, 2021

(51) Int. Cl.

| | |
|---|---|
| ***F21V 29/67*** | (2015.01) |
| ***F21V 29/76*** | (2015.01) |
| ***F21V 3/02*** | (2006.01) |
| ***F21V 21/116*** | (2006.01) |
| *F21Y 115/10* | (2016.01) |

(52) U.S. Cl.

CPC ..... *F21V 29/677* (2015.01); *F21V 3/026* (2013.01); *F21V 21/116* (2013.01); *F21V 29/763* (2015.01); *F21Y 2115/10* (2016.08)

(58) Field of Classification Search

CPC ..... F21V 21/116; F21V 29/763; F21V 3/026; F21V 29/677

See application file for complete search history.

(56) References Cited

U.S. PATENT DOCUMENTS

| | | | | |
|---|---|---|---|---|
| 5,782,668 | A * | 7/1998 | Chabert | F21V 3/023 446/220 |
| 6,012,826 | A * | 1/2000 | Chabert | F21V 3/026 362/363 |
| 6,764,201 | B2 * | 7/2004 | Chi-Cheng | A63H 27/10 362/352 |
| 6,966,676 | B2 * | 11/2005 | Chabert | F21V 3/023 362/352 |
| 7,824,079 | B2 * | 11/2010 | Cuppett | F21V 1/06 362/355 |
| 10,174,927 | B2 | 1/2019 | Nakamura | |
| 10,203,103 | B2 | 2/2019 | Bendtsen et al. | |
| 2007/0297174 | A1 * | 12/2007 | Girolami | F21V 3/026 362/253 |
| 2009/0237927 | A1 * | 9/2009 | Zheng | F21V 29/71 362/235 |
| 2013/0114260 | A1 | 5/2013 | Lopez et al. | |
| 2013/0301267 | A1 * | 11/2013 | Badley | F21V 17/10 362/249.1 |
| 2014/0211486 | A1 | 7/2014 | Rodriguez | |
| 2016/0327256 | A1 * | 11/2016 | Hall | F21S 8/036 |
| 2017/0108184 | A1 * | 4/2017 | Brannon | F21S 8/043 |
| 2017/0284648 | A1 * | 10/2017 | Nakamura | F21V 29/677 |
| 2019/0145613 | A1 * | 5/2019 | Blackwelder | F21S 2/00 362/427 |
| 2019/0285235 | A1 * | 9/2019 | Allison | F21V 33/006 |

* cited by examiner

*Primary Examiner* — Bryon T Gyllstrom
*Assistant Examiner* — Christopher E Dunay
(74) *Attorney, Agent, or Firm* — Lowenstein Sandler LLP

(57) ABSTRACT

A junction unit adapted for use in a lighting balloon apparatus is provided. The junction unit comprises a body, a first attachment region disposed on the body to couple to one or more lighting modules, and a second attachment region disposed on the body to couple to a header cable that provides power to the one or more lighting modules.

14 Claims, 8 Drawing Sheets

JUNCTION UNIT FOR USE IN A LIGHTING BALLOON APPARATUS

TECHNICAL FIELD

Embodiments of the present invention relate generally to a lighting apparatus and, more particularly, to a junction unit and lighting harness assembly to be incorporated into a lighting balloon apparatus.

BACKGROUND

Proper lighting is essential in the filming and photography industry. However, many of the traditional lighting solutions offered in the industry are limited by their ability to accommodate multiple applications. This is often the case, for example, when there are frequent changes in lighting requirements or placement position. Moreover, many lighting solutions that incorporate high output light-emitting diodes (LEDs) are difficult to use due to their high weight and substantial heat generation.

Accordingly, there is a need for improved lighting solutions with particular applicability in the filming and photography industry.

BRIEF DESCRIPTION OF THE DRAWINGS

The present invention is illustrated by way of example, and not by way of limitation, and will become apparent upon consideration of the following detailed description, taken in conjunction with the accompanying drawings, in which like reference characters refer to like parts throughout, and in which.

DETAILED DESCRIPTION

Figure 1A:
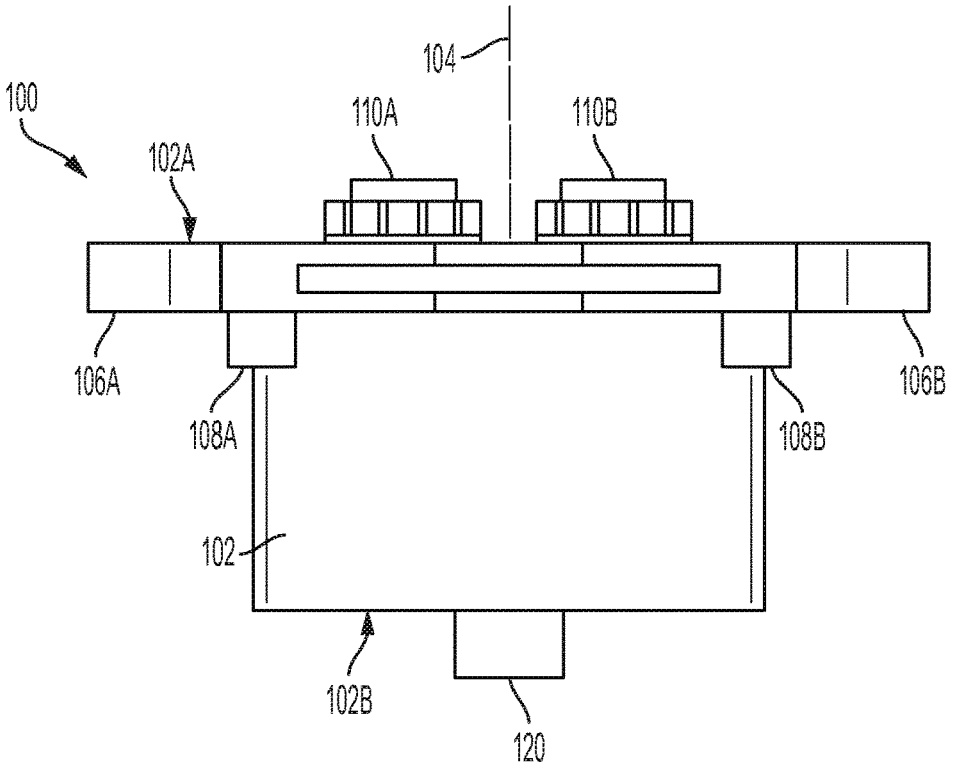
FIG. 1A illustrates a side view of a junction unit in accordance with an exemplary embodiment of the present invention.
Figure 1B:
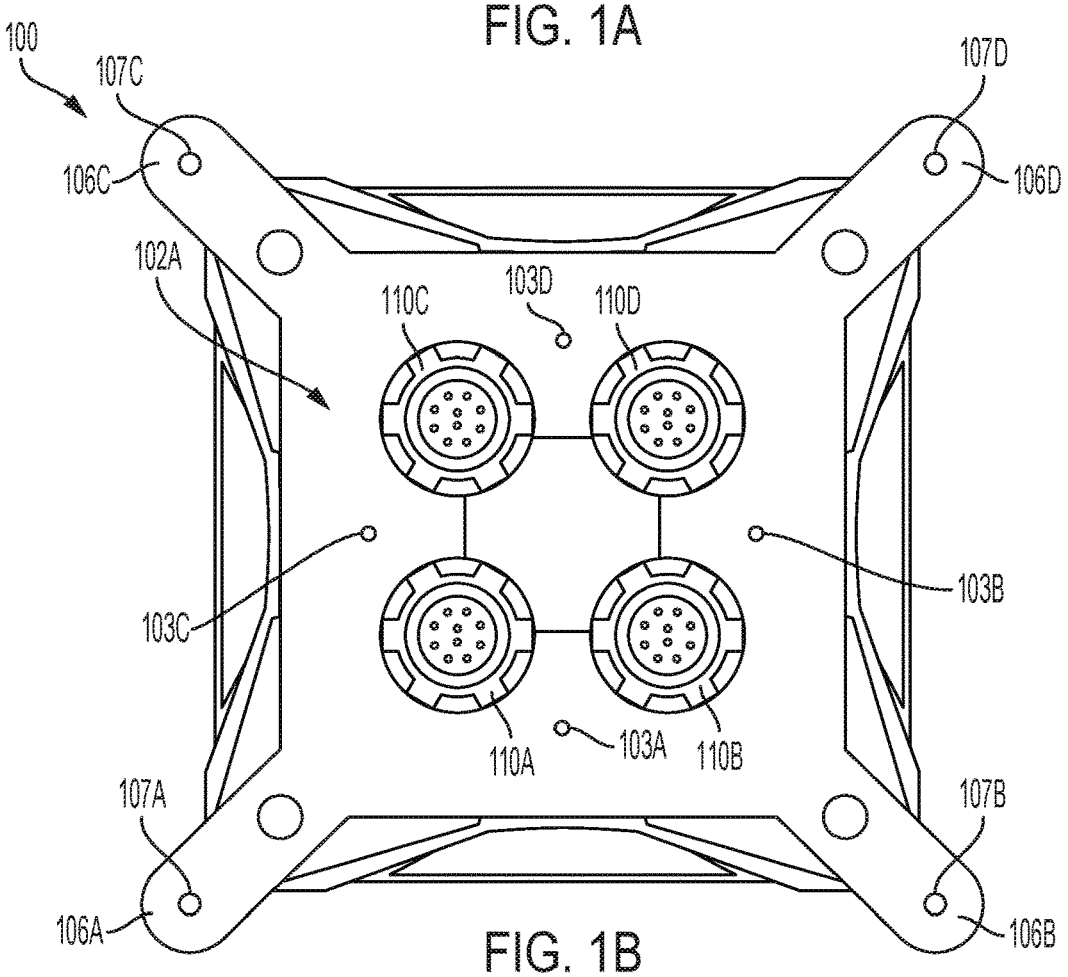
FIG. 1B illustrates a top view of the junction unit in accordance with an exemplary embodiment of the present invention.
Figure 1C:
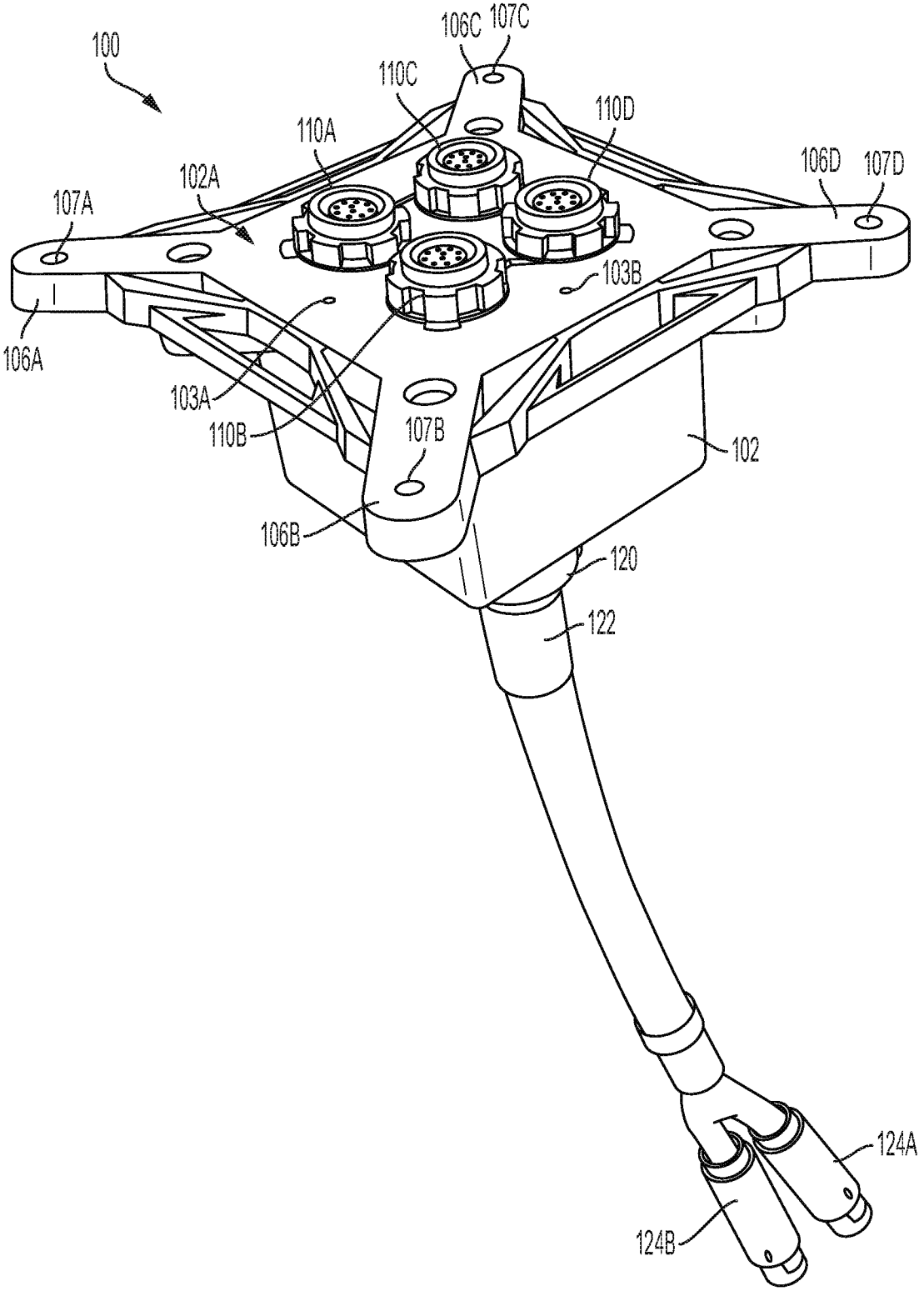
FIG. 1C illustrates a top perspective view of the junction unit in accordance with an exemplary embodiment of the present invention.
Figure 1D:
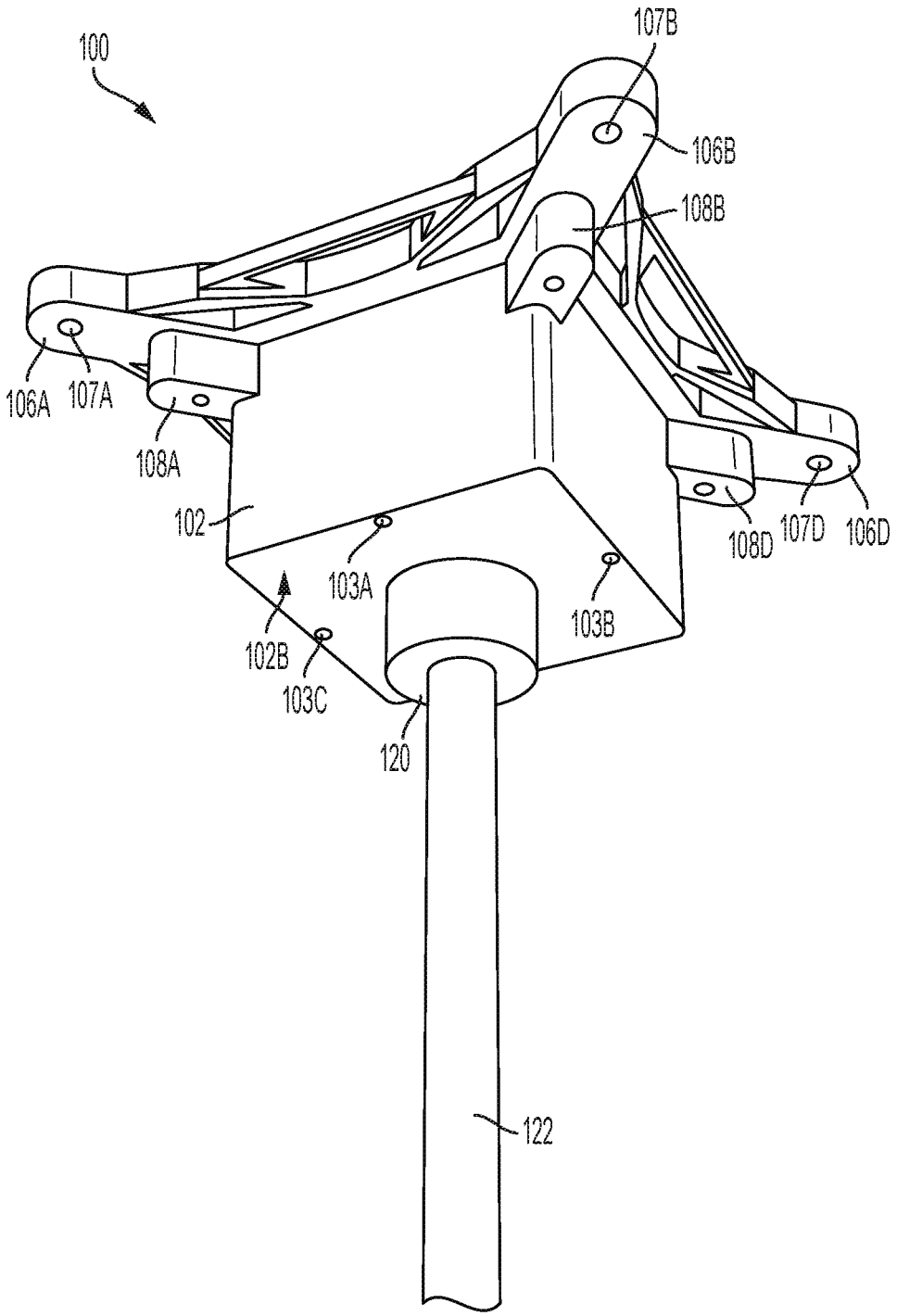
FIG. 1D illustrates a bottom perspective view of the junction unit in accordance with an exemplary embodiment of the present invention.

Embodiments of the present invention include a junction unit for insertion into a lighting balloon, a junction unit operably coupled to one or more lighting modules, a lighting assembly including a junction unit, and a lighting balloon apparatus incorporating a junction unit. The embodiments described herein allow for the assembly of high output LED lighting balloons while mitigating issues associated with weight and heat generation.

In certain embodiments, a junction unit serves as a hub for one or more lighting modules and routes power and signals to the one or more lighting modules. The lighting modules include light sources, such as LEDs, and may be actively or passively cooled. In embodiments that utilize active cooling, a lighting module may include a fan and optionally a heat sink. The fan circulates air to dissipate heat generated by the light sources when in operation. In embodiments that utilize passive cooling, a lighting module may include a heat sink without a fan. In certain embodiments, actively cooled modules may be powered by direct current (DC). In certain embodiments, passively cooled modules may be powered by alternating current (AC).

Active or passive cooling may be implemented during operation while the junction unit and lighting modules are suspended in a lighting harness assembly within a sealed balloon. In certain embodiments, the lighting harness assembly is disposed at the center of the balloon envelope to evenly distribute its weight. While the embodiments illustrated and described herein correspond to two-module and four-module assemblies, it is to be understood that the junction unit may be adapted to couple to any number of lighting modules, such as one, two, three, four, five, six, or more lighting modules. Moreover, it is to be understood that a lighting balloon apparatus may incorporate multiple lighting harness assemblies, which may be arranged in a manner that evenly distributes the overall weight of the lighting balloon apparatus (i.e., a centrally located center of mass).

In certain embodiments, the lighting harness assembly is arranged such that the light sources (e.g., LEDs) cast light in a downward direction (i.e., substantially along the direction of the earth's gravitational force) through the balloon envelope creating a diffused light effect. In certain embodiments, the LEDs may include one or more high color rendering index (CRI) LEDs, which may include daylight, tungsten, a "hybrid" of both color temperatures, and/or RGB-A (red, green, blue, amber).

FIGS. 1A-1D illustrate an embodiment of a junction unit 100 in accordance with an exemplary embodiment of the present invention. The junction unit 100 comprises a body 102, which may be solid or hollow. In certain embodiments, the body 102 is constructed from a durable material, such as a metal or a high-density plastic (e.g., polyvinyl chloride, polyethylene terephthalate, high density polyethylene, polypropylene, and polyurethane). The junction unit includes a first attachment region 102A and a second attachment region 102B which may, for example, be disposed on opposite surfaces of the body 102. Each of the first attachment region 102A and 102B may include mechanical adapters for physically securing one or more objects to the body 102, as well as ports for electrically coupling to one or more electronic components. The first attachment region 102A includes arms 106A-106D, which are depicted as being distributed symmetrically about the central axis 104 and extending radially outward from the body 102. Slots 107A-107D are formed in the arms 106A-106D, respectively, which are adapted to receive and secure lighting modules, as will be discussed later with respect to FIGS. 2A-2C. The slots 107A-107D may be in a form of apertures, for example, or other mechanical structures to facilitate mechanical coupling to their respective lighting modules, as would be appreciated by one of ordinary skill in the art. The body 102 may further include struts 108A-108D to provide structural support to the arms 106A-106D, respectively (strut 108C is obscured in FIGS. 1A-1D, but would be located behind strut 108A in FIG. 1A and below arm 106C in FIG. 1B).

The first attachment region 102A further includes module power ports 110A-110D, which are depicted as being distributed symmetrically about a central axis 104 of the body 102. It is to be understood that any suitable number of module power ports may be present, and need not be coplanar or distributed symmetrically as shown. Each of the module power ports 110A-110D is arranged to be adjacent to respective arms 106A-106D (e.g., module power port 110A is adjacent to arm 106A, module power port 110B is adjacent to arm 106B, etc.), though other suitable arrangements and configurations are possible.

The second attachment region 102B includes a source power port 120 which may be adapted to couple to a header cable 122, and may be a threaded connector that the header cable 122 can screw onto. In certain embodiments, the header cable 122 houses a plurality of electrically isolated channels to provide power to light sources (e.g., LEDs) of lighting modules coupled to the junction unit 100. In certain embodiments, when the header cable 122 is attached to the source power port 120, the channels within the header cable 122 are electrically coupled to channels housed within the body 102, which extend through the body 102 to establish electric coupling with respective module power ports 110A-110D. The header cable 122 terminates at connectors 124A and 124B, for example, which may be coupled to a power supply through one or more intermediate junctions. In certain embodiments, the power supply may comprise one or more power supplies connected together in series or in parallel. In certain embodiments, one or more solar panels may be utilized as a power source or in combination with one or more power sources.

The body 102 further includes apertures 103A-103D for receiving suspension cables that may be used to suspend the junction unit 100 in a harness arrangement, as will be discussed later with respect to FIGS. 3-5. In certain embodiments, the apertures 103A-103D pass through the body 102 from the first attachment region 102A to the second attachment region 102B.

Although the body 102 is depicted as box-shaped, it is to be understood that the body 102 may have other shapes, such as triangular, hexagonal, circular, or any other suitable shape to accommodate a substantially radial distribution of arms 106A-106D. Moreover, various dimensions of body 102 may be provided to accommodate different lighting applications. In certain embodiments, the body 102 may be omitted entirely resulting in a more compact form of the junction unit 100.

Figure 2A:
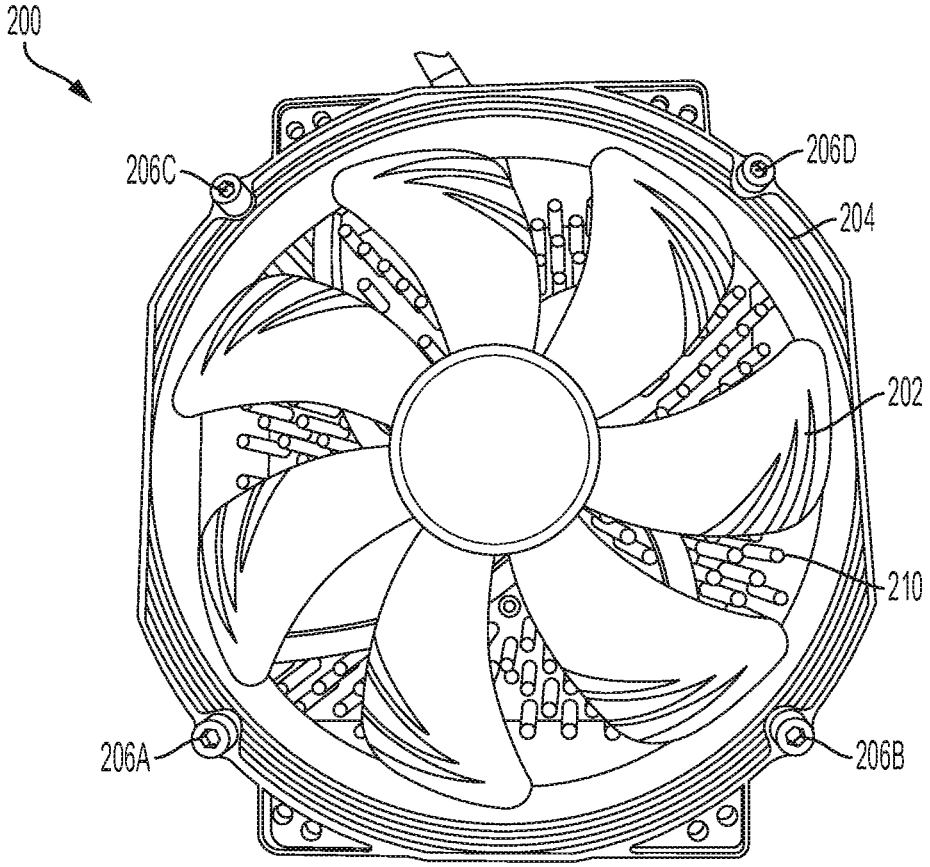
FIG. 2A illustrates a top view of a lighting module in accordance with an exemplary embodiment of the present invention.
Figure 2B:
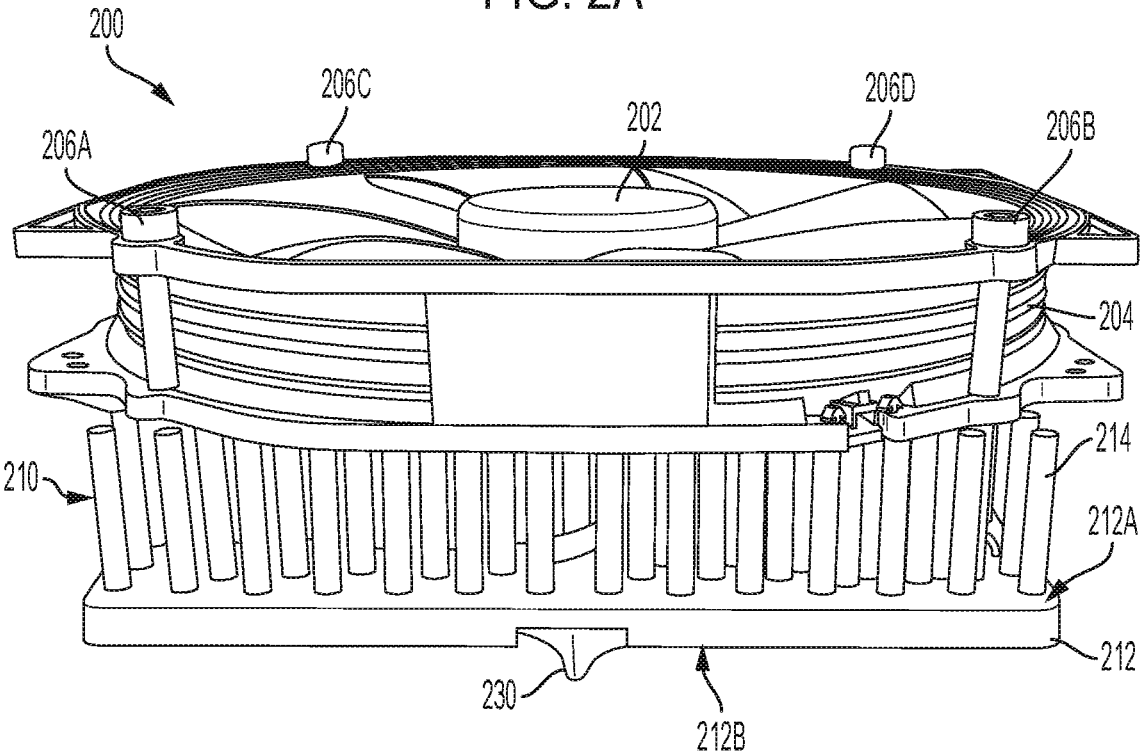
FIG. 2B illustrates a side view of the lighting module in accordance with an exemplary embodiment of the present invention.
Figure 2C:
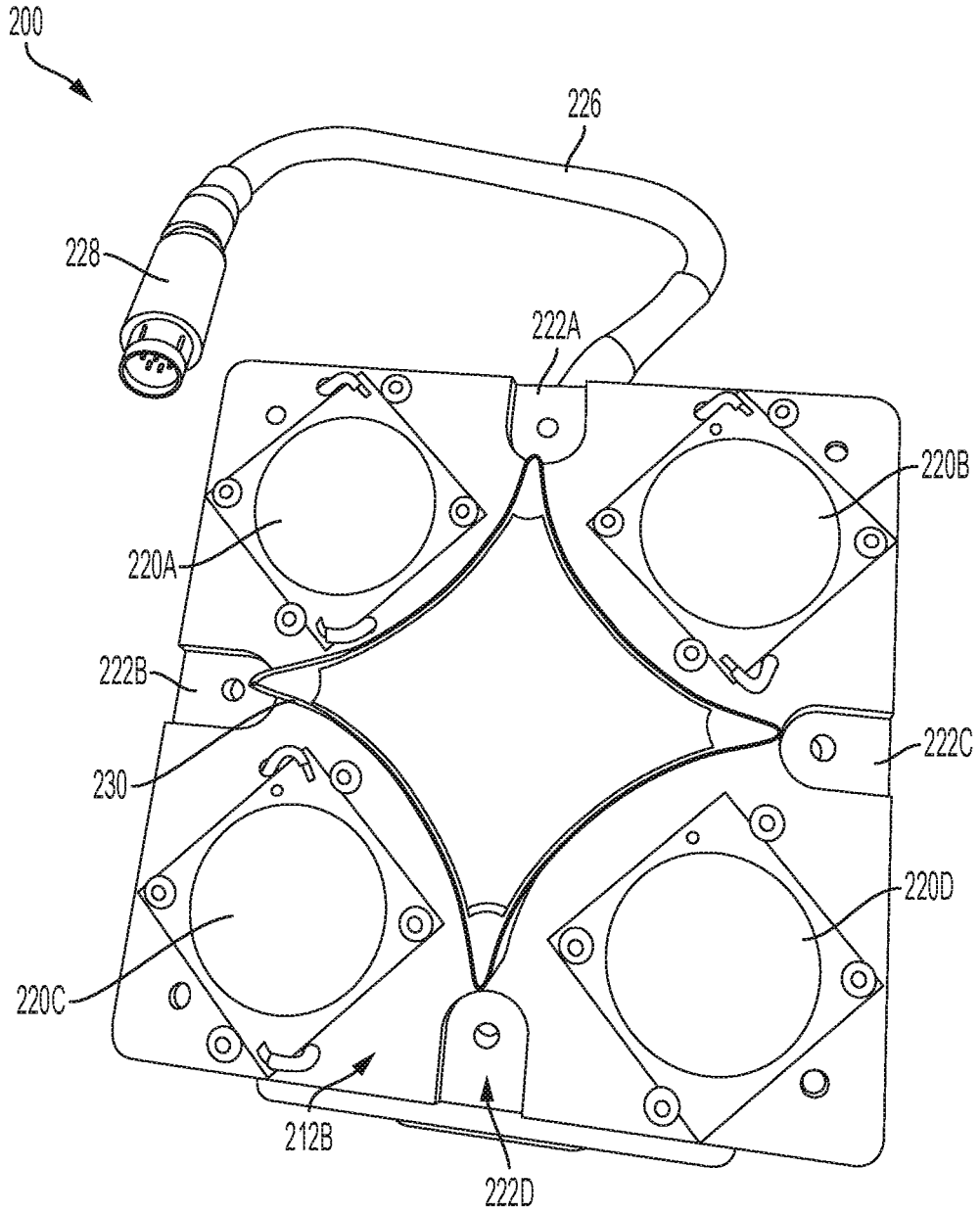
FIG. 2C illustrates a bottom view of the lighting module in accordance with an exemplary embodiment of the present invention.

FIGS. 2A-2C illustrates a lighting module 200 in accordance with an exemplary embodiment of the present invention. The lighting module 200 includes a fan 202, a heat sink 210, and a plurality of light sources 220A-220C. Active cooling (i.e., where the heat sink 210 is exposed to a continuous or semi-continuous flow of air) may be achieved in embodiments that include the fan 202, though the fan may 202 may be omitted in other embodiments. In embodiments where the lighting module 200 does not include the fan 202, such embodiments may be said to utilize passive cooling (i.e., where the heat sink 210 is exposed to a stationary air). The fan 202 includes a surrounding frame 204 which may couple to the heat sink 210 through connectors 206A-206D. For example, the connectors 206A-206D may be screws or fasteners that couple to, for example, a support plate 212 of the heat sink 210.

The heat sink 210 includes the support plate 212, which has an upper surface 212A having a plurality of columns 214 formed thereon. The columns 214 facilitate heat dissipation by providing high surface area for contacting the surrounding air. In embodiments that utilize the fan 202, the structure of the heat sink 210 allows for air flow to be circulated directly through the columns 214. In certain embodiments, the support plate 212 and the columns 214 are collectively formed from a single unitary metallic material.

Reference is now made to FIG. 2C, which illustrates a bottom view of the lighting module 200, and specifically the components disposed on a lower surface 212B of the support plate 212. Light sources 220A-220D are coupled directly to the lower surface 212B, which allows the light sources 220A-220D to be in direct contact with the heat sink. Power and control signals may be provided to the light sources 220A-220D through a power cable 226, which may include an adapter 228 that can be coupled to a module power port on a junction unit (e.g., one of the module power ports 110A-110B of the junction unit 100 described with respect to FIGS. 1A-1D). In certain embodiments, and as illustrated in FIG. 2C, the light sources 220A-220D may be chip on board (COB) LEDs. One or more of the light sources 220A-220D may be high color rendering index (CRI) LEDs adapted for daylight or tungsten color temperatures, for example. In certain embodiments, the high CRI LEDs may be adapted for a CRI of 87+, 90+, or 95+. In certain embodiments, one or more of the light sources 220A-220D may be an RGB-A LED. In certain embodiments, the light sources 220A-220D may be blended collectively as a hybrid of color temperatures (e.g., light source 220A may be a tungsten LED, light source 220B may be a daylight LED, etc.). In certain embodiments, the light sources 220A-220D may be controlled individually or together as a group. In embodiments where the light sources 220A-220D are individually controlled, the power cable 226 may include individual electrically isolated channels that power each of the light sources 220A-220D individually. In certain embodiments, one or more of the light sources 220A-220D may include a lens that is coupled directly or indirectly thereto or is integrally formed thereon.

The lower surface 212B of the support plate 212 further includes a spacer 230, which protects the light sources 220A-220D from damage when the lighting module is placed on a surface. In certain embodiments, the surfaces of the spacer 230 are reflective to reflect light generated by the light sources 220A-220D. The lower surface 212B of the support plate 212 may further comprise coupling regions 222A-222D which are adapted to facilitate coupling of the lighting module 200 to an arm of a junction unit (e.g., one of the arms 106A-106D of the junction unit 100 described with respect to FIGS. 1A-1D). It is to be understood that any of the light sources 220A-220D, the heat sink 210, the support plate 212, or the fan 202 may have other shapes, such as such as triangular, hexagonal, circular, or any other suitable shape.

Figure 3:
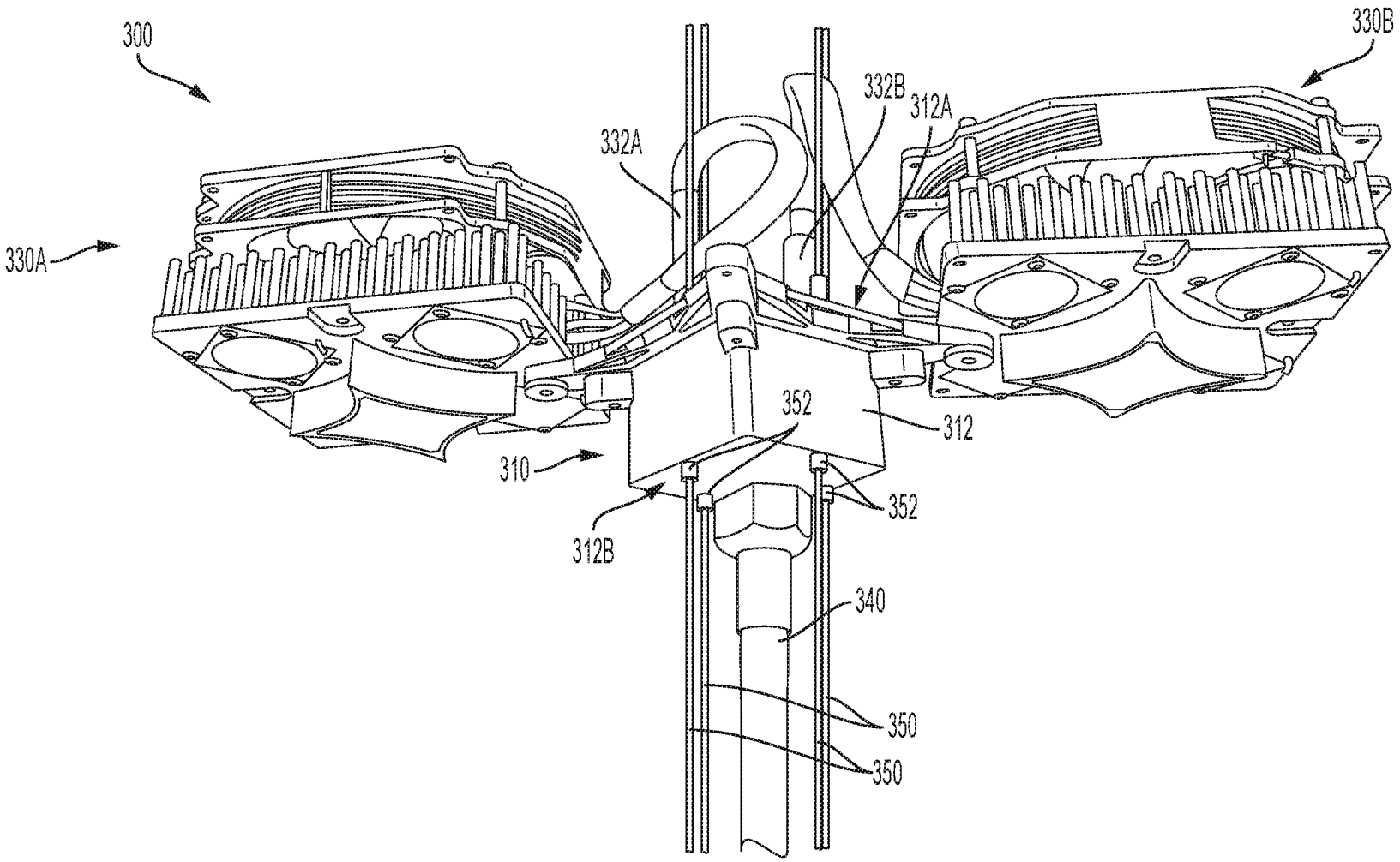
FIG. 3 illustrates a bottom perspective view of a lighting harness assembly including two lighting modules coupled to a junction unit in accordance with an exemplary embodiment of the present invention.

FIG. 3 illustrates a bottom perspective view of a lighting harness assembly 300 including two lighting modules 330A and 330B coupled to a junction unit 310 in accordance with an exemplary embodiment of the present invention. The lighting modules 330A and 330B and junction unit 310 may be the same as or similar to the aforementioned components that were identically named. The lighting modules 330A and 330B are illustrated as being coupled to arms of a first attachment region 312A of a body 312 of the junction unit 310, and a header cable 340 is illustrated as being coupled to a second attachment region 312B of the body 312. The lighting modules 330A and 330B are electrically coupled to module power ports (not visible) of the first attachment region 312A via their respective power cables 322A and 322B.

The lighting harness assembly 300 further includes suspension cables 350 which pass through apertures of the body 312 (e.g., the apertures 103A-103D). The body 320 may be oriented such that the second attachment region 312B faces direction of gravitational force. In this configuration, the suspension cables include stationary stops 352 that are each wider than the diameters of the apertures of the body 312. The stationary stops 352 which allow the body to rest thereon so that the position of the junction unit 310 and the lighting modules 330A and 330B may be adjusted when suspended within a lighting balloon apparatus simply by adjusting the suspension cables 350. In certain embodiments, the suspension cables 350 may be aluminum cables or any other material suitable for supporting the weight of the lighting harness assembly 300.

Figure 4:
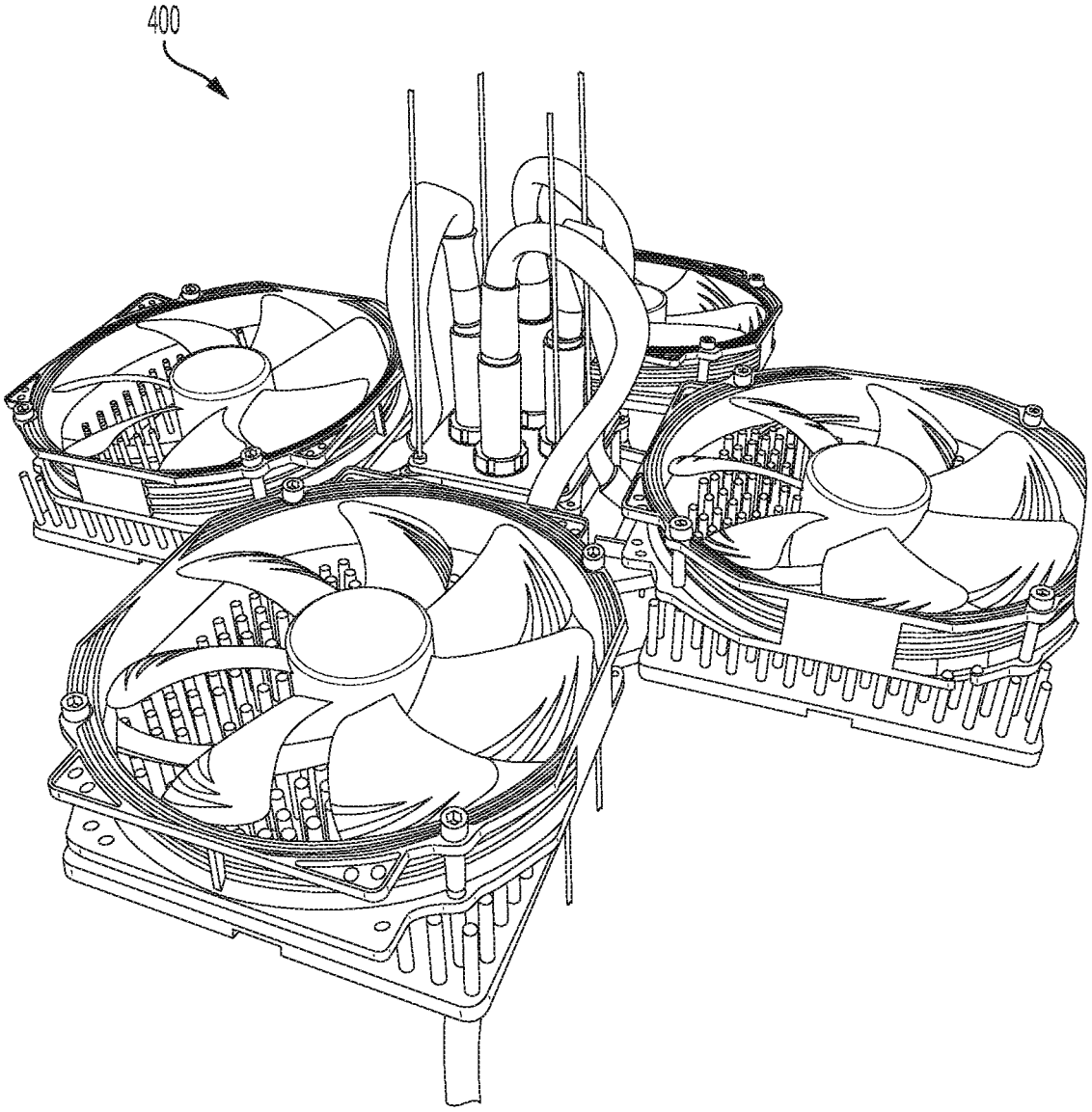
FIG. 4 illustrates a top perspective view of a lighting harness assembly including four lighting modules coupled to a junction unit in accordance with an exemplary embodiment of the present invention.

FIG. 4 illustrates a top perspective view of a lighting harness assembly 400 which includes four lighting modules coupled to a junction unit in accordance with an exemplary embodiment of the present invention. The lighting harness assembly 400 may utilize the same or similar components as illustrated in FIG. 3.

Figure 5:
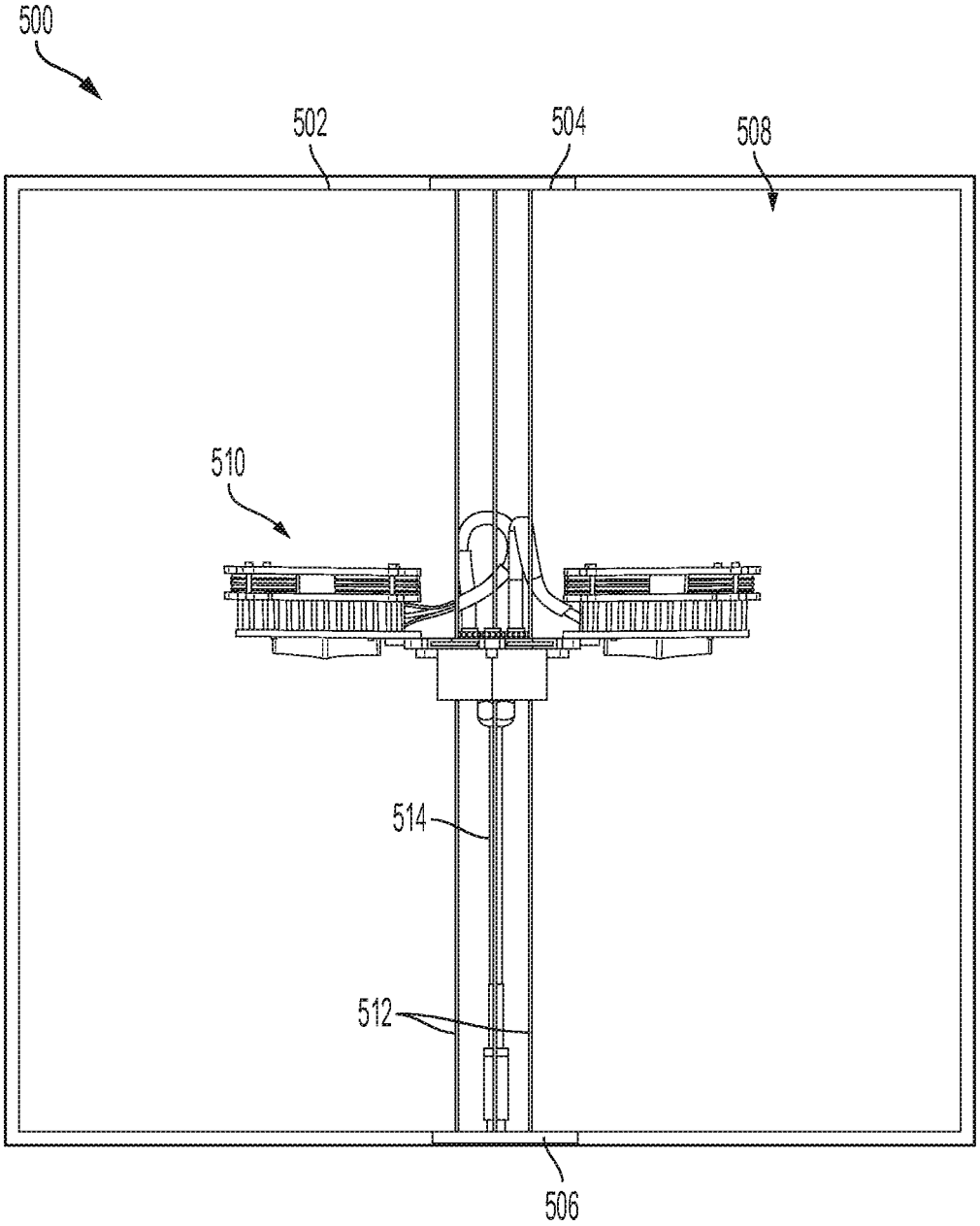
FIG. 5 illustrates a side view of a lighting balloon apparatus including a lighting harness assembly in accordance with an exemplary embodiment of the present invention.

FIG. 5 illustrates a side view of a lighting balloon apparatus 500 including a lighting harness assembly 510 in accordance with an exemplary embodiment of the present invention. The lighting harness assembly 510 may be the same as or similar to the lighting harness assembly 300, and includes suspension cables 512.

The lighting balloon apparatus 500 includes a balloon envelope 502 that serves as an illuminating body through which light produced by the light sources of the lighting harness assembly 510 passes. The balloon envelope 502 may be constructed as a rectangular-shaped body having six orthogonally-fixated sides, though it is to be understood that other suitable shapes may be utilized, such as a cylinder, cuboid, octagon, etc. In certain embodiments, the lighting balloon apparatus 500 may have one or more physical dimensions (e.g., height, width, length, diameter) independently selected from 2 feet to 20 feet or larger.

In certain embodiments, the balloon envelope 502 comprises a material having a medium weight laminate of polyester film weaved into polyester fabric using an adhesive containing an antimicrobial additive, to reduce the incidence of mildew, and an ultraviolet (UV) inhibitor. This material may be cut into various sized templates and affixed together using double sided adhesive tape. The material may also be treated with a UV inhibitor. In certain embodiments, a reflective material may be affixed or deposited onto an interior surface area of an upper surface of the balloon envelope 502 to direct, as well as increase, the illuminating output of the light sources enclosed within. In certain embodiments, one or more portions of the balloon envelope 502 may be opaque, partially opaque, translucent, or transparent. For example, in certain embodiments, a lower portion of the balloon envelope 502 may be transparent or partially opaque. In certain embodiments, the balloon envelope 502 is the same as or similar to the balloon envelope illustrated and described in U.S. Pat. No. 7,641,351 B2, the disclosure of which is hereby incorporated by reference herein in its entirety.

The balloon envelope 502 includes an upper cap 504 and a lower cap 506, which anchor the suspension cables 512 therebetween. The upper cap 504 and lower cap 506 may each include, for example, a receiver ring containing stainless steel shackles to provide a stable core for suspending the lighting harness assembly 510. The lower cap 506 may further include a port that a header cable 514 may pass through or interface with in order to provide power from an external power source to the lighting harness assembly 510. Additionally, the upper cap 504 and lower cap 506 may include o-rings in order to completely seal an interior volume 508 defined by the balloon envelope 502 to allow balloon envelope 502 to maintain a volume of helium gas. The suspension cables 512 may be rigid enough to maintain a level of rigidity of the balloon envelope 502 during inflation of the lighting balloon apparatus 500.

In certain embodiments, the balloon envelope 502 includes a zipper to allow access to the interior volume 508, for example, to insert the lighting harness assembly 510 prior to inflating the lighting balloon apparatus 500. In certain embodiments, the zipper is an air-tight and/or water-tight zipper, such as a TIZIP® zipper.

In certain embodiments, a power supply may be onboard the lighting balloon apparatus 500, such as a battery. In certain embodiments, the lighting balloon apparatus 500 may include a solar panel located on an upper surface of the balloon envelope 502.

In certain embodiments, the junction harness assembly is suspended within the interior volume 508 such that the center of mass of the lighting balloon apparatus is substantially located at a geometric center of the interior volume 508 enclosed by the sealed balloon envelope 502. It is to be understood that the single lighting harness assembly 510 in FIG. 5 is merely illustrative, as additional lighting harness assemblies may be enclosed within the balloon envelope 502.

In the foregoing description, numerous details are set forth. It will be apparent, however, to one of ordinary skill in the art having the benefit of this disclosure, that the present disclosure may be practiced without these specific details. In some instances, well-known structures and devices are shown in block diagram form, rather than in detail, in order to avoid obscuring the present disclosure.

The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or." That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Reference throughout this specification to "an embodiment" or "one embodiment" means that a particular feature, structure, or characteristic described in connection with the embodiment is included in at least one embodiment. Thus, the appearances of the phrase "an embodiment" or "one embodiment" in various places throughout this specification are not necessarily all referring to the same embodiment.

The present disclosure is not to be limited in scope by the specific embodiments described herein. Indeed, other various embodiments of and modifications to the present disclosure, in addition to those described herein, will be apparent to those of ordinary skill in the art from the preceding description and accompanying drawings. Thus, such other embodiments and modifications are intended to fall within the scope of the present disclosure. Further, although the present disclosure has been described herein in the context of a particular embodiment in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein, along with the full scope of equivalents to which such claims are entitled.

What is claimed is:

1. A junction unit adapted for use in a lighting balloon apparatus, the junction unit comprising:

a body;

a first attachment region disposed on the body, the first attachment region comprising:

a plurality of arms that extend radially outward from the body and are each adapted to couple to and secure a lighting module away from the body; and a plurality of module power ports;

a second attachment region disposed on the body, the second attachment region comprising a source power port adapted to couple to a header cable comprising a plurality of electrically isolated source channels; and a plurality of power channels disposed within the body that are adapted to transmit power from the source power port to each of the plurality of module power ports in a one-to-one correspondence with the plurality of electrically isolated source channels of the header cable when coupled thereto.

2. The junction unit of claim 1, wherein the body further comprises two or more apertures formed therethrough.

3. The junction unit of claim 1, wherein there is a one-to-one correspondence of the plurality of arms to the plurality of module power ports, and wherein each module power port is disposed adjacent to its respective arm.

4. The junction unit of claim 1, wherein the body is radially symmetric about a central axis, and wherein the plurality of arms is distributed symmetrically about the central axis.

5. The junction unit of claim 4, wherein the first attachment region and the second attachment region are disposed on opposite facing surfaces of the body.

6. The junction unit of claim 5, wherein the plurality of arms are disposed on the body in coplanar fashion.

7. The junction unit of claim 1, further comprising the header cable.

8. The junction unit of claim 1, wherein a first arm of the plurality of arms is coupled to a lighting module, wherein a first module power port of the plurality of module power ports is coupled to a power cable of the lighting module, and wherein the lighting module comprises a light source and a heat sink.

9. A lighting balloon apparatus comprising:

a sealed balloon envelope;

a junction unit suspended within the sealed balloon envelope; and a plurality of lighting modules coupled to the junction unit, the plurality of lighting modules each comprising a light source, a heat sink, and a power cable electrically coupled to the junction unit, wherein the junction unit is configured to couple each of the plurality of lighting modules in a one-to-one correspondence with a plurality of electrically isolated source channels of a header cable when coupled thereto.

10. The lighting balloon apparatus of claim 9, further comprising a plurality of suspension cables received through apertures formed through the junction unit and coupled to opposing harness couples within the sealed balloon envelope.

11. The lighting balloon apparatus of claim 10, wherein the junction unit is suspended by the suspension cables such that the center of mass of the lighting balloon apparatus is substantially located at a geometric center of a volume enclosed by the sealed balloon envelope.

12. The lighting balloon apparatus of claim 9, wherein the plurality of lighting modules is distributed symmetrically around the junction unit.

13. The lighting balloon apparatus of claim 9, wherein at least one of the plurality of lighting modules comprises a light source that comprises a chip on board (COB) light emitting diode (LED).

14. The lighting balloon apparatus of claim 9, wherein at least one of the plurality of lighting modules comprises a fan adapted to circulate air flow away from the heat sink.

* * * * *